US005086518A

United States Patent [19]

Staley

[11] Patent Number: 5,086,518

[45] Date of Patent: Feb. 11, 1992

[54] METHOD FOR MAKING A VENTED SOCK

[76] Inventor: William L. Staley, 10265 Gandy Blvd., Apt. 1214, St. Petersburg, Fla. 33702

[21] Appl. No.: 696,264

[22] Filed: Apr. 30, 1991

Related U.S. Application Data

[63] Continuation of Ser. No. 475,340, Feb. 5, 1990, abandoned.

[51] Int. Cl.[5] ..... A41B 11/00

[52] U.S. Cl. ..... 2/239; 2/409; 66/178 R

[58] Field of Search ..... 2/61, 239, 409; 66/178 R, 196

[56] References Cited

U.S. PATENT DOCUMENTS

| | | | |
|---|---|---|---|
| 294,020 | 2/1884 | Eisendrath | 2/239 X |
| 1,577,752 | 3/1926 | Price | 2/61 X |
| 2,239,593 | 4/1941 | Crawford | 66/178 R |
| 2,248,303 | 7/1941 | Morgenroth et al. | 2/239 |
| 2,674,740 | 4/1954 | Kidd | 2/61 |
| 3,259,915 | 7/1966 | Dison | 2/239 |
| 3,566,624 | 3/1971 | Burleson | 2/409 |
| 3,600,717 | 8/1971 | McKeehan | 2/239 X |
| 3,815,156 | 6/1974 | Gaither | 2/409 |
| 4,069,600 | 1/1978 | Wise | 2/61 |
| 4,126,903 | 11/1978 | Horton | 2/409 |
| 4,213,312 | 7/1980 | Safrit et al. | 2/409 X |
| 4,341,096 | 7/1982 | Safrit et al. | 2/239 X |
| 4,373,215 | 2/1983 | Guigley | 2/239 |
| 4,467,626 | 8/1984 | Coble et al. | 66/196 |
| 4,571,960 | 2/1986 | Hursh et al. | 66/196 |
| 4,615,188 | 10/1986 | Hursh et al. | 66/196 |
| 4,843,844 | 7/1989 | Hursh et al. | 66/196 |
| 4,870,708 | 10/1989 | Staley . | |

FOREIGN PATENT DOCUMENTS

| | | | |
|---|---|---|---|
| 48231 | 1/1911 | Austria | 2/239 |
| 216752 | 1/1961 | Austria | 2/239 |
| 825235 | 8/1949 | Fed. Rep. of Germany | 2/239 |
| 1041303 | 2/1984 | Japan | 2/239 |
| 0081303 | 5/1985 | Japan | 2/239 |
| 8907523 | 8/1989 | PCT Int'l Appl. | 2/239 |

*Primary Examiner*—Werner H. Schroeder
*Assistant Examiner*—Jeanette E. Chapman
*Attorney, Agent, or Firm*—Foley & Lardner

[57] ABSTRACT

A double-layered sock according to the invention includes an inner sock made of a moisture-permeable material such as polypropylene and an outer sock that absorbs such moisture. The inner sock is interposed between the skin of the foot and the absorbed moisture, providing enhanced warmth and comfort. The inner and outer layers are secured together, such as by sewing at the toe portion of each to form the double sock.

8 Claims, 2 Drawing Sheets

METHOD FOR MAKING A VENTED SOCK

This is a continuation of application Ser. No. 07/475,340 filed Feb. 5, 1990, abandoned.

TECHNICAL FIELD

This invention relates to socks, particularly to knitted socks wherein an outer sock is doubled over an inner sock.

BACKGROUND OF THE INVENTION

It is a common practice to wear a second pair of socks over a first pair in order to obtain additional warmth. An outer sock joined at the toe to the toe end of an undergarment has also been proposed in Staley U.S. Pat. No. 4,870,708, issued Oct. 3, 1989. However, such double socks tend to trap moisture, such as from perspiration, causing discomfort and loss of warmth. The present invention provides a double sock which addresses these disadvantages.

SUMMARY OF THE INVENTION

A vented sock according to the invention includes a main portion and a vent panel of lighter weight than the main portion, the vent panel being located on the to of the sock near its toe end.

A double-layered sock according to the invention includes an inner layer made of a moisture-permeable material and an outer layer that absorbs such moisture. The inner layer acts a barrier between the skin of the foot and the absorbed moisture. The inner and outer layers are secured together to form the double sock. According to one aspect of the invention, the double sock comprises an inner sock made of a non-water absorbent, moisture-pervious material which is joined at the toe to an outer sock made of an moisture-absorbent material.

BRIEF DESCRIPTION OF THE DRAWING

The invention will now be described with reference to the accompanying drawing figures, wherein like numerals denote like elements, and.

DETAILED DESCRIPTION

Figure 1:
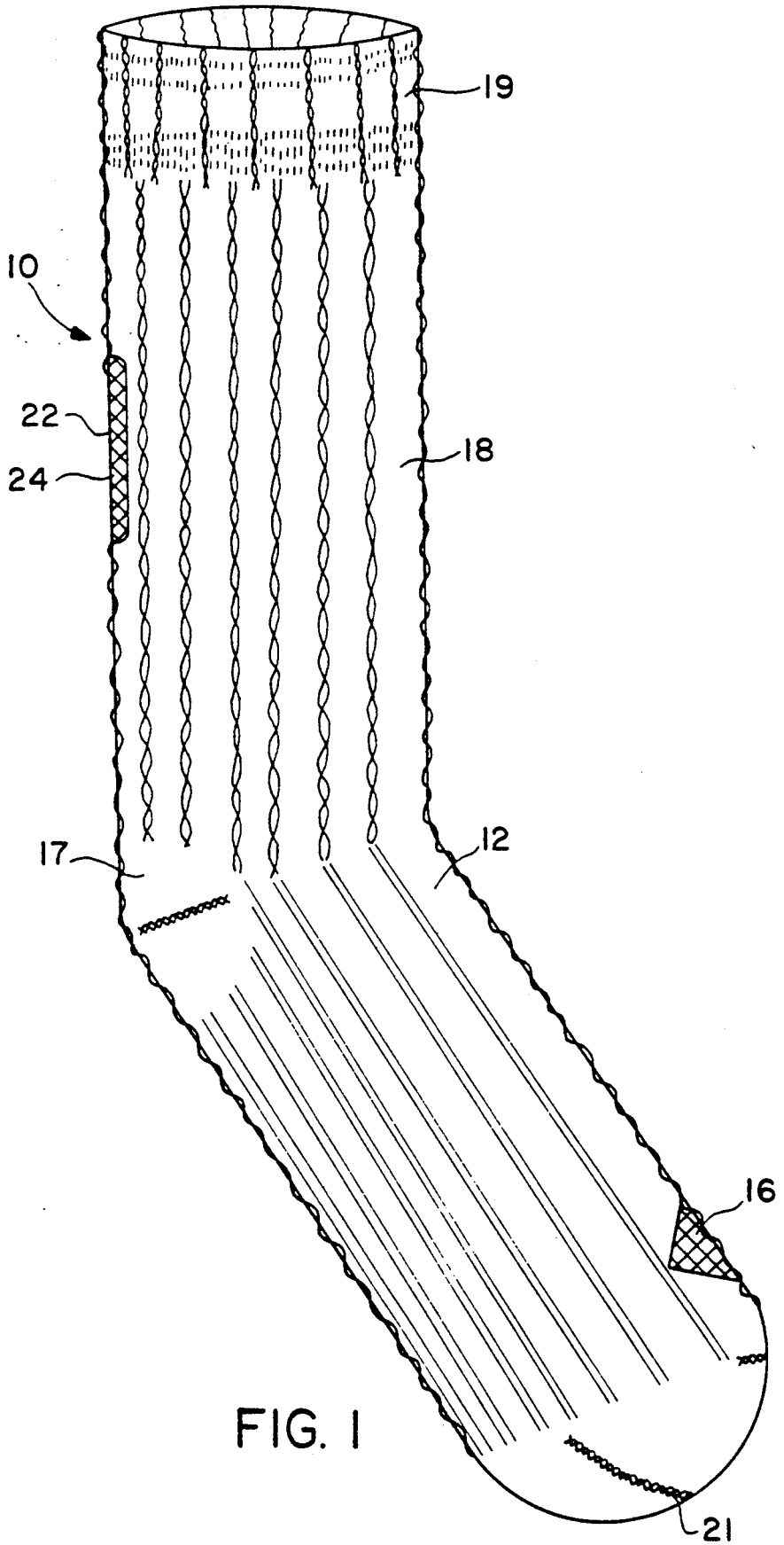
FIG. 1 is a top view of a double-layered sock according to the invention laid flat.
Figure 2:
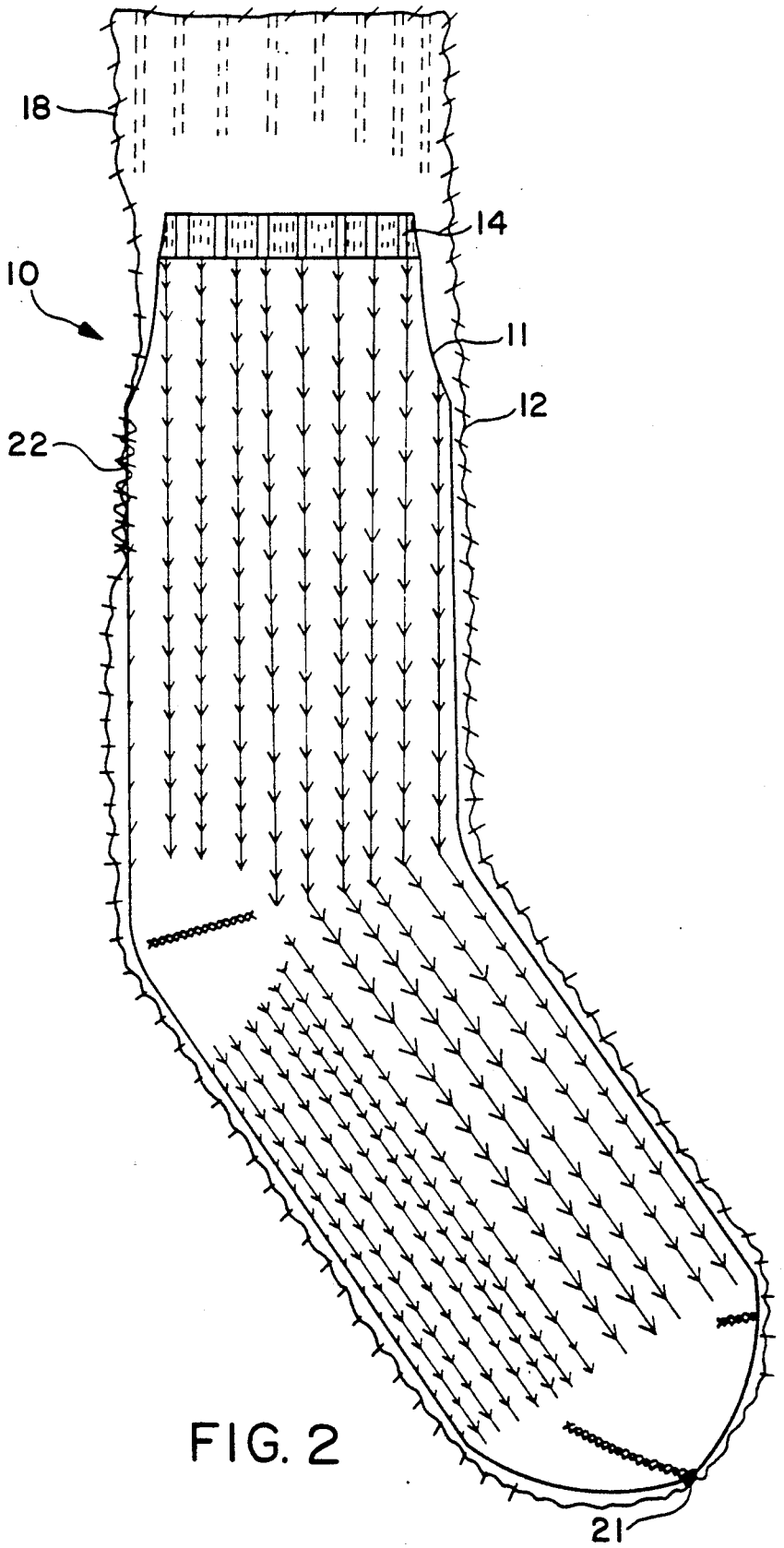
FIG. 2 is the same view as FIG. 1, with the outer sock shown in section to reveal the inner sock.

Referring now to FIGS. 1 and 2, a double-layered sock 10 according to the invention comprises an inner sock 11 having water vapor transfer properties and an outer sock 12 which is water absorbent. Inner sock 11 is made of a material which is substantially non-water absorbent and which is water-pervious, so that it tends to draw moisture away from the foot into outer sock 12. Polypropylene fibers have these characteristics, and inner sock 11 is preferrably made of at least 30% by weight of polypropylene, particularly 50–90% polypropylene. Since polypropylene fibers of the type useful in a sock tend to have limited resiliency, inner sock 11 preferably contains no more than 70%, especially 10–50% by weight of a second fabric which has the needed stretchability, such as stretch nylon.

Inner sock 11 may be knitted made on a circular knitting machine. The ends of two strands of 2-70-34 (2-ply, 70 denier, 34 filaments per strand) stretch nylon of two different selected colors are ply twisted to a total weight of 140 denier. A second yarn made of polypropylene or any similar fiber is floated over (plaited on top of) the first yarn during the circular knitting process to form the main portion of the tube. The second yarn typically is a 2-100-52 polypropylene fiber. An inner sock having these characteristics has well-balanced weight, warmth, stretchability and vapor transfer properties. Inner sock 11 may have an elastic cuff 14 to provide extra support. Cuff 14 is formed by knitting in elastic yarn made of lycra, spandex, or the like.

Outer sock 12 may be any conventional, moisture-absorbing sock, such as a wool, acrylic, nylon or cotton sock. Outer sock 12 is typically heavier and more bulky than inner sock 11 to provide more warmth. In the illustrated embodiment, outer sock 12 is knitted in substantially the same manner as sock 11, using an inner facing of stretch nylon interlooping with the absorbent yarn of cotton, wool, acrylic, etc.

Outer sock 12 has a small vent panel 16 located near its toe end on the top of the sock. In general, vent panel 16 is made of a lighter weight material than the main portion of sock 12 and is thin enough to allow water vapor to pass readily therethrough. In the area of vent 16 the second (absorbent) yarn is omitted during knitting so that only the stretch nylon is present. During knitting, the second yarn may be carried behind the panel 16 without substantially hindering the escape of water vapor, which can then escape readily from the shoe, particularly if vent holes are present near the toe of the shoe as are common in modern athletic shoes. Panel 16 is diamond shaped, but may have any suitable size or shape. The ankle-covering portion 18 of outer sock 12 is preferably slightly longer than the corresponding portion of inner sock 11 so that inner sock 11 is effectively concealed. Outer sock 12 has an elastic cuff 19 similar to cuff 14.

Inner and outer socks 11, 12 are secured together by any suitable means, such as sewing, Velcro or snap fasteners, or the like. The entire sock may be continuously knitted from a single tube by switching the second yarn from the polypropylene yarn to the absorbent yarn about half way along and sewing the tube together at the center to form a double-tube sock. In the illustrated embodiment, socks 11, 12 are knitted separately and then sewn together toe-to-toe by a fishmouth seam 21. Optionally, socks 11, 12 may also be sewn together at a second location, such as at cuffs 14, 19, to prevent the two socks from slipping relative to one another when worn.

In the embodiment shown, socks 11, 12 are sewn along a lengthwise seam 22 located on ankle portion 18 above the heel portion 17. This secures socks 11, 12 in a nested relationship as shown in FIG. 2. To make seam 22 less conspicuous, outer sock 12 may have a second panel 24 similar to panel 16. Sewing inner sock 11 to outer sock 12 at panel 24 compensates for the additional weight of the seam by reducing the weight of outer sock 12 at that location.

A double sock according to the invention combines enhanced warmth with improved comfort. The outer absorbent layer works in combination with the inner non-absorbent layer to keep perspiration away from the skin.

It will be understood that the above description is of preferred examples of the invention, and that the invention is not limited to the specific forms shown. For example, the inner and outer socks could be fashioned as a single sock having an inner layer made of the non-absorbent, moisture-pervious fabric and an outer layer made of the water-absorbent fabric. This and other modifications may be made in the design and arrangement of the elements without departing from the scope of the invention as expressed in the appended claims.

What is claimed is:

1. A method for making a sock including a main portion and a vent panel of lighter weight than said main portion, the vent panel being located on the top of the sock near its toe end, comprising the steps of:

circularly knitting a tubular blank using a doubled yarn comprising a first yarn and a second yarn, the blank having a pair of open ends;

selectively omitting the second yarn during knitting of the blank to form a vent panel proximate one end of the blank, which vent panel is made of the first yarn only; and sewing said one end of the blank closed to form said sock.

2. The method of claim 1, wherein the second yarn is made of polypropylene.

3. The method of claim 1, wherein the first yarn is made of stretch nylon.

4. The method of claim 3, wherein the second yarn is made of polypropylene.

5. The method of claim 1, wherein the knitting step further comprises plaiting said second yarn on top of said first yarn.

6. The method of claim 5, wherein the omitting step further comprises carrying the second yarn behind the first yarn to form the vent panel.

7. The method of claim 1, wherein said vent panel is sized to overlie a wearer's toes, such that the bottom of the sock and portions of the sock adjoining the vent panel on the top and sides of the sock, near its toe end, are part of the main portion of the sock and are of heavier weight than the vent panel.

8. The method of claim 7, wherein the vent panel is generally diamond-shaped.

* * * * *